US008977159B2

(12) United States Patent
Takehara et al.

(10) Patent No.: US 8,977,159 B2
(45) Date of Patent: Mar. 10, 2015

(54) IMAGE FORMING APPARATUS

(71) Applicants: Kenichi Takehara, Kanagawa (JP); Hiromitsu Fujiya, Kanagawa (JP); Keisuke Yuasa, Kanagawa (JP); Tomoyasu Hirasawa, Kanagawa (JP); Keisuke Ikeda, Kanagawa (JP); Yasuaki Toda, Kanagawa (JP)

(72) Inventors: Kenichi Takehara, Kanagawa (JP); Hiromitsu Fujiya, Kanagawa (JP); Keisuke Yuasa, Kanagawa (JP); Tomoyasu Hirasawa, Kanagawa (JP); Keisuke Ikeda, Kanagawa (JP); Yasuaki Toda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/905,728

(22) Filed: May 30, 2013

(65) Prior Publication Data

US 2013/0322915 A1 Dec. 5, 2013

(30) Foreign Application Priority Data

Jun. 4, 2012 (JP) ..... 2012-127193
Aug. 27, 2012 (JP) ..... 2012-186492

(51) Int. Cl.
*G03G 21/20* (2006.01)

(52) U.S. Cl.
CPC ..... *G03G 21/20* (2013.01); *G03G 21/206* (2013.01)
USPC ..... 399/94; 399/92

(58) Field of Classification Search
USPC ..... 399/94
See application file for complete search history.

(56) References Cited

U.S. PATENT DOCUMENTS

| | | | | |
|---|---|---|---|---|
| 6,819,892 | B2 | 11/2004 | Nakazato et al. | |
| 2003/0091363 | A1 * | 5/2003 | Hoffman et al. | 399/92 |
| 2012/0051778 | A1 | 3/2012 | Nishino et al. | |
| 2012/0183314 | A1 | 7/2012 | Nishino et al. | |

FOREIGN PATENT DOCUMENTS

| | | |
|---|---|---|
| JP | 58-217982 | 12/1983 |
| JP | 2003-122208 | 4/2003 |
| JP | 2006-313383 | 11/2006 |
| JP | 3924484 | 3/2007 |
| JP | 2012-048160 | 3/2012 |
| JP | 2012-073596 | 4/2012 |
| JP | 2012-145820 | 8/2012 |

* cited by examiner

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

An image forming apparatus includes an air-conditioning section to control at least one of temperature and humidity of air, a first passage to guide the air sent off by the air-conditioning section to a temperature-controlled portion in the image forming apparatus, an air-intake section to take in the air from outside of the image forming apparatus, and a second passage to guide the air taken in by the air-intake section to the temperature-controlled portion.

11 Claims, 9 Drawing Sheets

FIG.8

| | | AIR-CONDITIONING DEVICE | 1ST FAN | 2ND FAN |
|---|---|---|---|---|
| T1t≦T2t | T1≦T1t<br>T2≦T2t | HEATING OPERATION<br>CONTROL TO MAKE T2 BE T2t | CONTROL TO MAKE T1 BE T1t | STOP |
| | T1>T1t<br>T2≦T2t | COOLING OPERATION<br>CONTROL TO MAKE T1 BE T1t | STOP | CONTROL TO MAKE T2 BE T2t |
| | T1≦T1t<br>T2>T2t | COOLING OPERATION<br>CONTROL TO MAKE T2 BE T2t | CONTROL TO MAKE T1 BE T1t | STOP |
| | T1>T1t<br>T2>T2t | COOLING OPERATION<br>CONTROL TO MAKE T1 BE T1t | STOP | CONTROL TO MAKE T2 BE T2t |
| T2t<T1t | T1≦T1t<br>T2≦T2t | HEATING OPERATION<br>CONTROL TO MAKE T1 BE T1t | STOP | CONTROL TO MAKE T2 BE T2t |
| | T1>T1t<br>T2≦T2t | COOLING OPERATION<br>CONTROL TO MAKE T1 BE T1t | STOP | CONTROL TO MAKE T2 BE T2t |
| | T1≦T1t<br>T2>T2t | COOLING OPERATION<br>CONTROL TO MAKE T2 BE T2t | CONTROL TO MAKE T1 BE T1t | STOP |
| | T1>T1t<br>T2>T2t | COOLING OPERATION<br>CONTROL TO MAKE T2 BE T2t | CONTROL TO MAKE T1 BE T1t | STOP |

IMAGE FORMING APPARATUS

BACKGROUND OF THE INVENTION

1. Field of the Invention

The disclosures herein generally relate to an image forming apparatus, especially an image forming apparatus that has a function to control temperature at a specific portion in the image forming apparatus to a predetermined temperature.

2. Description of the Related Art

FIG. 11 is a general configuration diagram of a conventional image forming apparatus. The image forming apparatus 1 is a monochrome printer. In FIG. 11, the image forming apparatus 1 includes a photoreceptor 201; an image-creating-process unit 211 including a charging device 202 and a developing device 204 that are disposed along the external circumference of the photoreceptor 201 and configure a unit with the photoreceptor 201; an exposure device 203; a transfer device 205; a cleaning device 206; a sheet feeder 207; a fixing device 209; and an electric unit 210. The image-creating-process unit 211 can be attached to or detached from a main body 212 of the image forming apparatus 1 as a whole.

The charging device 202 charges the surface of the photoreceptor 201, which is exposed by the exposure device 203 with colors of image data to form a latent image. The developing device 204 develops the latent image formed on the surface of the photoreceptor 201 by toner to form a toner image, which is transferred from the surface of the photoreceptor 201 to a sheet supplied from the sheet feeder 207 by the transfer device 205. The cleaning device 206 cleans the surface of the photoreceptor 201 after the toner image has been transferred. The fixing device 209 is disposed at a downstream position relative to the transfer device 205.

Sheets which are held in a sheet feeding tray of the sheet feeder 207 are conveyed to a resist roller 208 by the sheet conveying section in response to a printing request. Here, a sheet is conveyed from the resist roller 208 to the transfer device 205 to transfer the toner image at a proper timing. After the toner image has been transferred on the sheet by the transfer device 205, the sheet is conveyed to the fixing device 209, where the toner image is fixed by heat and pressure.

The charging device 202, the developing device 204, and the transfer device 205 are connected with the electric unit 210 to have a predetermined bias applied. The electric unit 210 includes an AC power source (constant voltage), a first DC power source (constant voltage), and a second DC power source (constant current) inside of the electric unit 210. With these power sources, the developing device 204 has a DC voltage applied by constant-voltage control, the charging device 202 is applied with an AC voltage by constant-voltage control, and the transfer device 205 has a DC voltage applied by constant-current control.

In such an electrophotographic image forming apparatus 1, image forming elements in the image forming apparatus 1 tend to be influenced by environmental changes. Especially, characteristics of the elements are change by temperature and humidity, which should be taken care of.

As for temperature, it is known that a temperature rise occurs at various portions in the image forming apparatus 1 such as the exposure (writing) device 203, the fixing device 209, the developing device 204, and a driving motor for driving the photoreceptor (image bearing member) 201 or the like to rotate. For example, frictional heat may cause a temperature rise at the developing device 204, which is generated between the developer and a member for stirring and conveying the developer when they are rubbed together by an operation of the member, or within the developer for the same reason.

Also, frictional heat is generated by friction between the developer on a developer bearing member and a developer restricting member that restricts the layer thickness of the developer before the developer is conveyed to a development area, by friction within the developer when restricted by the developer restricting member, which may cause a temperature rise in the developing device 204.

If temperature rises in the developing device 204, toner charge is reduced while toner adherence increases, which make it difficult to obtain a predetermined image density. The temperature rise also makes the toner melt to condense. The condensed toner may adhere to the developer restricting member, the developer bearing member, the image bearing member, etc., which induces a risk that an abnormal image with stripes is generated. Especially, in recent years, low-melting-temperature toner has been used to decrease fixing energy, with which abnormal images are likely to be generated due to the condensed toner.

As for humidity, the air composition in the image forming apparatus 1, especially humidity, may destabilize image quality because an image is created by the photoreceptor 201 with charged fine particles such as toner, carriers, and the like, whose charged state is affected by humidity in the image forming apparatus 1. For example, the fine particles such as toner, carriers, and the like used in a electrophotographic device are designed to be made of polymeric resin with a charge controlling agent added to stabilize the electrostatic charged state of the particles. However, electric characteristics of polymeric resin cause absorption of moisture in the air to induce changes in electrical resistance, friction coefficient between granular materials, fluidity, and the like even if hydrophobic treatment or the like is applied. Consequently, the amount of toner charge in the developing device 204 is reduced, which results in image quality changes such as an increased density.

In the charging device 202 using electrical discharge phenomenon, when an electrical discharge occurs, a nitric acid compound is generated, then, is combined with moisture in the air to generate ionized materials such as nitric acid and nitrate, which adhere to the surface of the photoreceptor 201. With the adhesion, the surface of the photoreceptor 201 deteriorates fast, which causes an abnormal abrasion of the photoreceptor 201. Also, ionized materials make the surface conductive, which generates fuzz on an electrostatic latent image, or an image deletion.

To cope with these problems primarily, an air-conditioning section may be provided. As a general air-conditioning section, a vapor-compression-type refrigerator is shown in FIGS. 12A-12C with its configuration and principles of operation. FIGS. 12A-12C are schematic views illustrating the configuration and principles of operation of a vapor-compression-type refrigerator as a general air-conditioning section. In FIG. 12A, the vapor-compression-type refrigerator is configured with a compressor 101 for compressing coolant, a first heat exchanger (condenser) 102 for heat exchange between the coolant and the air, a second heat exchanger (evaporator) 103, an expansion valve 104 for decompressing the coolant, and a four-way valve 105 for switching passages of the coolant. The vapor-compression-type refrigerator can heat or cool the air by repeating the following cycle.

1. Compression

Low-pressure, low-temperature coolant vapor is compressed by the compressor 101, to generated high-pressure, high-temperature coolant vapor.

2. Condensation

The high-pressure, high-temperature coolant vapor generated by the compressor 101 is fed to the first heat exchanger 102 to exchange heat with the air for cooling, to become liquid coolant (the air is heated).

3. Expansion

The high-pressure liquid coolant liquefied by the first heat exchanger 102 is decompressed by the expansion valve 104.

4. Evaporation

The liquid coolant decompressed by the expansion valve 104 is evaporated by the second heat exchanger 103 to absorb heat from the air (the air is cooled).

The above process is explained with a T-s diagram (temperature entropy diagram) on temperature T and entropy S in FIG. 12C. The compressor 101 compresses dry saturated vapor A of the coolant up to a pressure above the saturated vapor pressure corresponding to a predetermined temperature in the first heat exchanger 102 to generate overheated saturated vapor B, which is fed to the first heat exchanger 102. The overheated saturated vapor B fed to the first heat exchanger 102 discharges heat Q1 by heat exchange with the air to be liquefied to become saturated liquid C. The saturated liquid C is fed to the expansion valve 104 to undergo isenthalpic expansion in the expansion valve 104 and to become wet vapor D, which is fed to the second heat exchanger 103. The wet vapor D fed to the second heat exchanger 103 absorbs heat Q2 from the air, to be evaporated to become dry saturated vapor A again.

FIG. 12B shows a state of the four-way valve 105 switched from a state shown in FIG. 12A. Namely, the passage of the coolant shown in FIG. 12A that goes through the compressor 101, the first heat exchanger 102, the expansion valve 104, and the second heat exchanger 103 is changed by the four-way valve 105 to the passage of the coolant shown in FIG. 12B that goes through the compressor 101, the second heat exchanger 103, the expansion valve 104, and the first heat exchanger 102 so that the first heat exchanger 101 and the second heat exchanger 103 function both ways as a condenser and an evaporator, or an evaporator and a condenser, respectively.

If an image forming apparatus as a whole is to be cooled by such an air-conditioning device, the capacity to be controlled becomes too large to keep modest cost, size, noise, and power consumption.

Thereupon, an air conditioning technology is disclosed that partially cools down only an image creation portion including a photoreceptor, a developing unit and the like, for example, in Japanese Laid-open Patent Publication No. 2003-122208 (Patent document 1) and Japanese Patent No. 3924484 (Patent document 2).

In Patent document 1, a technology that aims to efficiently remove a material harmful to image forming from the surroundings of a photoreceptor is disclosed as follows. An image forming apparatus includes a main body case, an image forming unit having a photoreceptor housed in an image forming case, and an air-conditioning section. The image forming unit has an opening formed for image transfer where a part of the photoreceptor is exposed. The opening is the only opening through which a material harmful to image forming may flow into the image forming unit when attached to the main body case. The air-conditioning section removes a material harmful to image forming which may flow into the image forming unit from the outside. The image forming apparatus also includes a passage that starts from the outside of the image forming unit, goes through the inside of the image forming unit, and goes out the outside of the image forming unit. At the entrance of passage, the air-conditioning section is disposed. The image forming apparatus also includes a circulation passage along which air inside of the image forming unit is discharged out of the image forming unit and again introduced into the image forming unit. The air-conditioning section is also disposed in the middle of the circulation passage.

In Patent document 2, a technology is disclosed that aims to maintain satisfactory performance of scraping residual toner on a photosensitive body with a cleaning blade in an electrophotographic image forming apparatus even if temperature and humidity are changed in an environment where the electrophotographic image forming apparatus is installed. The image forming apparatus includes: a temperature adjusting device for heating or cooling air to supply heated or cooled air; an air-conditioning section having a function of adjusting temperature of the cleaning blade; a temperature sensor for measuring the temperature of the cleaning blade; and a temperature control section which drives the air-conditioning section in response to a detected temperature by the temperature sensor and a reference temperature set in advance so that the cleaning blade scrapes off residual toner appropriately at a controlled temperature. At least the photosensitive body, a developing unit and a cleaning unit are held in a well-closed case of an image creation module where image forming takes place for a color. Multiple image creation modules are provided for different colors. Temperatures in the image creation modules are adjusted by the air-conditioning section to keep the reference value of temperature set for each of the image creation modules.

Also disclosed in Patent document 2 is an image forming apparatus includes a humidity adjusting section for adjusting humidity used instead of or along with the temperature adjusting section, which refers to a reference value of humidity instead of or along with the reference value of temperature.

In an image forming apparatus, when controlling temperature with an air-conditioning device, it is difficult to achieve fine control of temperature only with the air-conditioning device. In addition, if there are multiple portions in the image forming apparatus whose temperatures need to be controlled at different target temperatures, it is difficult to achieve the target temperatures at the temperature-controlled portions, respectively, because a cooled or heated wind at substantially the same temperature is sent to all the temperature-controlled portions.

On the other hand, it may be possible to individually control the amount of flow of the air sent to each temperature-controlled portion for heat exchange so that the temperature of each temperature-controlled portion can be controlled. In this case, the temperature and amount of flow of the air sent from the air-conditioning device are not independent, hence it requires appropriate control of a compressor of the air-conditioning device, output of a fan (the number of rotations) of a heat exchanger, the amount of flow sent to each temperature-controlled portion, and the like. However, in a situation where the amounts of heat at portions in the image forming apparatus are changing considerably, for example, soon after a starting-up or a change of operation mode, it is difficult to control the temperatures of the temperature-controlled portions appropriately.

SUMMARY OF THE INVENTION

It is a general object of at least one embodiment of the invention to provide an image forming apparatus that substantially obviates one or more problems caused by the limitations and disadvantages of the related art. Specifically, it may be desirable to provide an image forming apparatus in which efficient temperature control can be executed even in a situation where the amounts of heat generated at temperature-controlled portions in the image forming apparatus are changing considerably.

According to at least one embodiment of the invention, an image forming apparatus includes an air-conditioning section to control at least one of temperature and humidity of air, a first passage to guide the air sent off by the air-conditioning section to a temperature-controlled portion in the image forming apparatus, an air-intake section to take in the air from outside of the image forming apparatus, and a second passage to guide the air taken in by the air-intake section to the temperature-controlled portion.

According to at least one embodiment of the invention, it is possible to control temperature efficiently even in a situation where the amount of heat generated at a temperature-controlled portion is changing considerably.

BRIEF DESCRIPTION OF THE DRAWINGS

Other objects and further features of embodiments will be apparent from the following detailed description when read in conjunction with the accompanying drawings, in which:

FIG. 8 is a schematic view of control patterns illustrating a control method executed by a control device according to the fifth embodiment;

DESCRIPTION OF THE PREFERRED EMBODIMENTS

In the following, embodiments of the present invention will be described with reference to the accompanying drawings. In the following embodiments, the same members or members that can be viewed as the same are attached with the same numeral codes, whose explanation or illustration may be omitted if appropriate.

[First Embodiment]

Figure 1A:
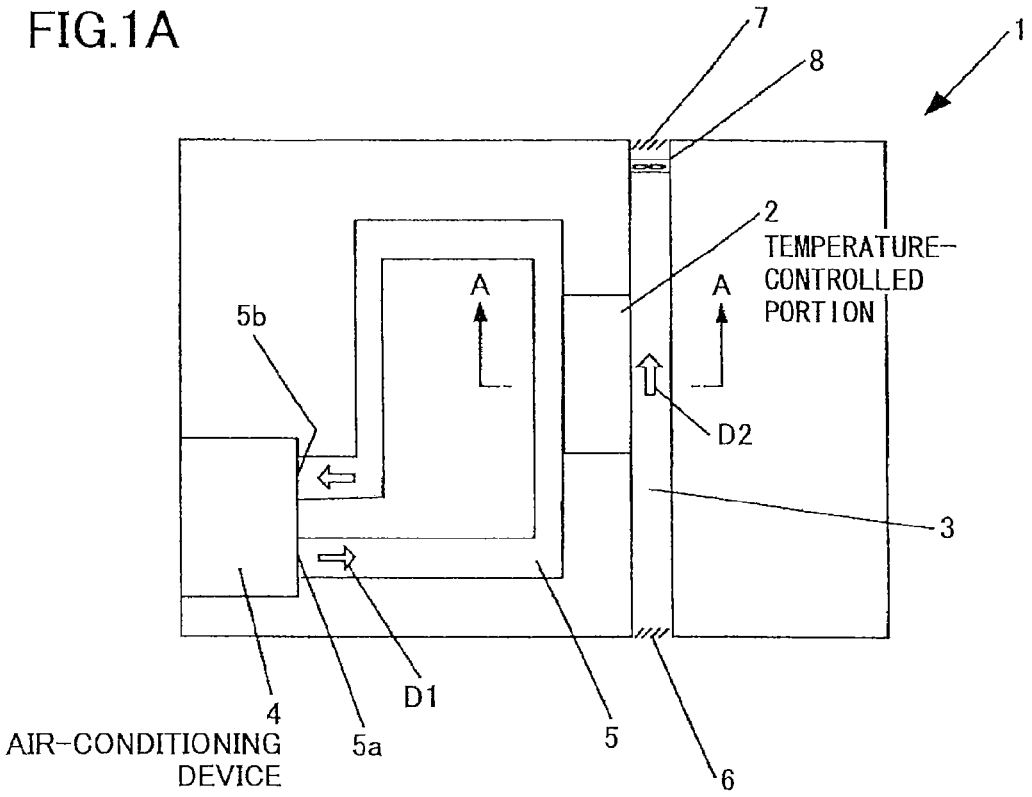
FIGS. 1A-1B are general configuration diagrams of an image forming apparatus according to a first embodiment of the invention.
Figure 1B:
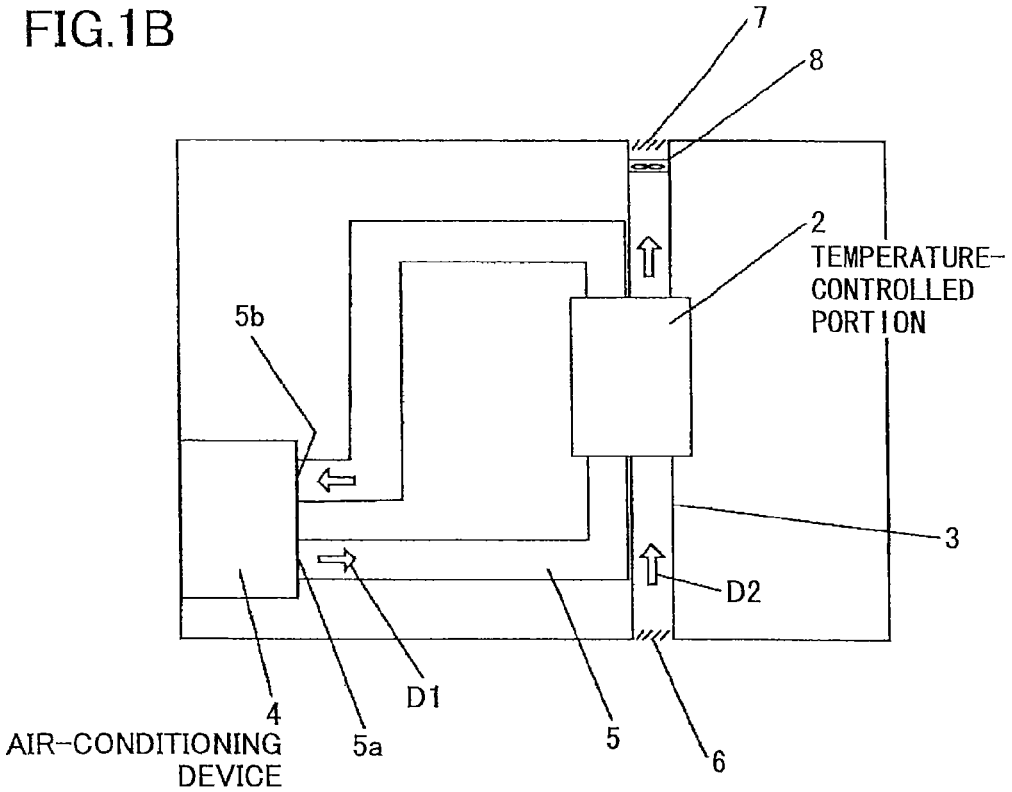
Figure 11:
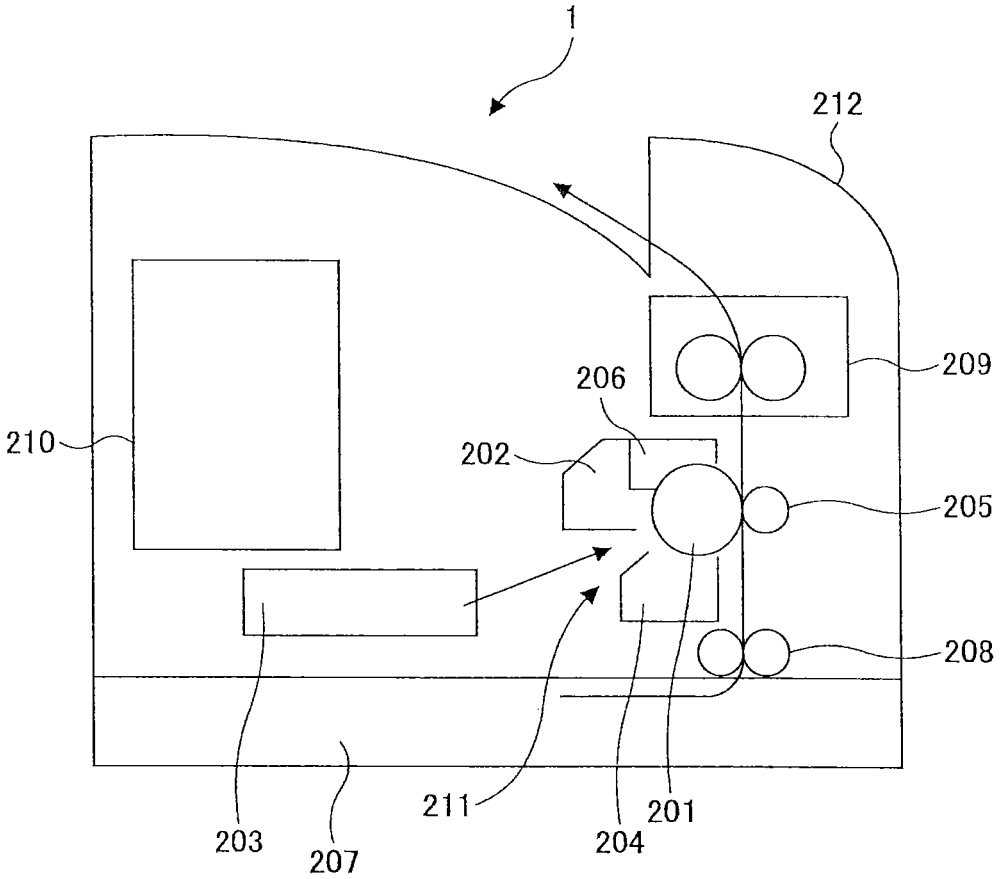
FIG. 11 is a general configuration diagram of a conventional image forming apparatus.

FIGS. 1A-1B are general configuration diagrams of an image forming apparatus according to the first embodiment of the invention. In FIG. 1A, the image forming apparatus 1 in the present embodiment includes an open-air duct 3 for taking in the open air sent to a temperature-controlled portion 2, an air-conditioning device 4, and a duct 5 for supplying air-conditioned (temperature-controlled) air from the air-conditioning device 4 to the temperature-controlled portion 2. Here, image forming elements included in the image forming apparatus 1 are the same as the ones shown in the image forming apparatus 1 in FIG. 11, whose explanation is omitted.

The open-air duct 3 includes an air inlet 6 that is an opening disposed at a predetermined location in the image forming apparatus 1, an air outlet 7 disposed at a different location from the location of the air inlet 6, and a fan 8 in the air outlet 7. The fan 8 is driven and controlled by a control device, or a CPU (not shown), which takes in the open air from the air inlet 6, then exhausts the air from the air outlet 7.

Figure 12A:
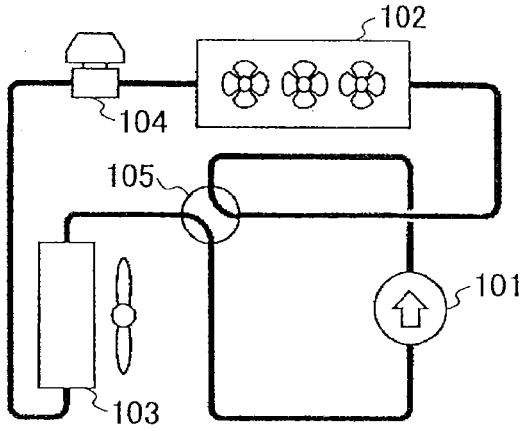
FIGS. 12A-12C are schematic views illustrating the configuration and principles of operation of a vapor-compression-type refrigerator as a general air-conditioning section.
Figure 12B:
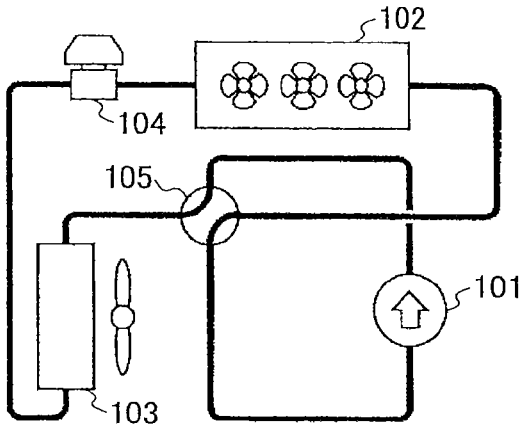
Figure 12C:
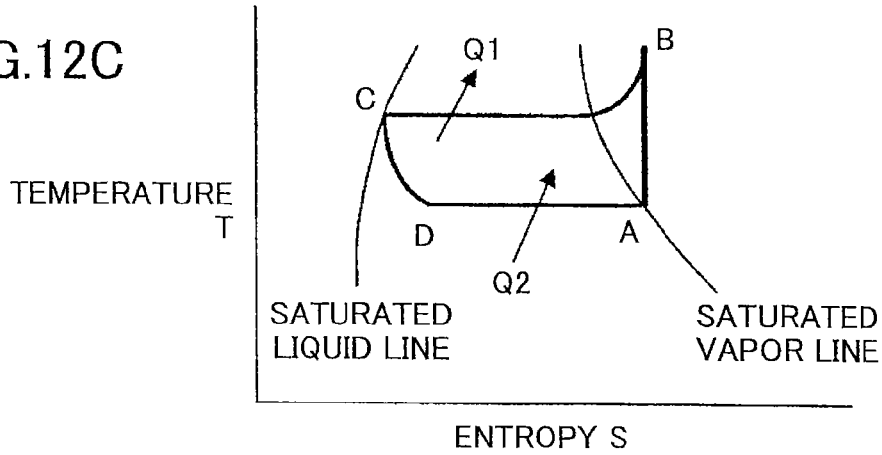

The air-conditioning device 4 sends off air for heat exchange to the temperature-controlled portion 2 from one end (outlet 5*a*) of the duct 5 forming a circulation passage to exchange heat at the temperature-controlled portion 2, and takes in temperature-raised air from the other end (inlet 5*b*) of the duct 5. During the circulation process, heat is exchanged according to the principles of heat exchange shown in FIG. 12. The air is sent off from the outlet 5*a* again, and the cycle is repeated.

The example shown in FIG. 1A has the open-air duct 3 and the duct 5 disposed adjacent to the temperature-controlled portion 2, whereas the example shown in FIG. 1B, which is modified from the example in FIG. 1A, has the open-air duct 3 and the duct 5 disposed in and through the temperature-controlled portion 2.

Namely, in the image forming apparatus 1, there is a portion that needs temperature control, and that is the temperature-controlled portion 2. The air for heat exchange (called a "circulating flow D1", hereafter) sent off by the air-conditioning device 4 goes through the duct 5 to make contact with (see FIG. 1A) or to flow into (see FIG. 1B) the temperature-controlled portion 2, again goes through the duct 5 to return to the air-conditioning device 4. A flow that goes through the open-air duct 3 (called "flow D2" hereafter) comes from the outside of the image forming apparatus 1, which has substantially the same temperature as atmosphere outside of the image forming apparatus 1. The amount of flow D2 taken in the open-air duct can be changed by the output of the fan 8.

Configured in this way, at the temperature-controlled portion 2, in contrast to a heating or cooling effect (heat exchange effect) by the circulating flow D1 from the air-conditioning device 4, the amount of flow D2 of the open air taken in from the outside of the image forming apparatus 1 can be changed by the output of the fan 8. Consequently, the temperature-controlled portion 2 can be controlled to take a predetermined temperature easily and finely.

Here, in the present embodiment, the example has the single temperature-controlled portion 2. If multiple temperature-controlled portions 2 are provided, a similar configuration may be taken in which the circulating flow D1 from the air-conditioning device 4 is sent off to each of the temperature-controlled portions 2, and the amount of flow of the open air is controlled for heat exchange to obtain a desired temperature.

Figure 2A:
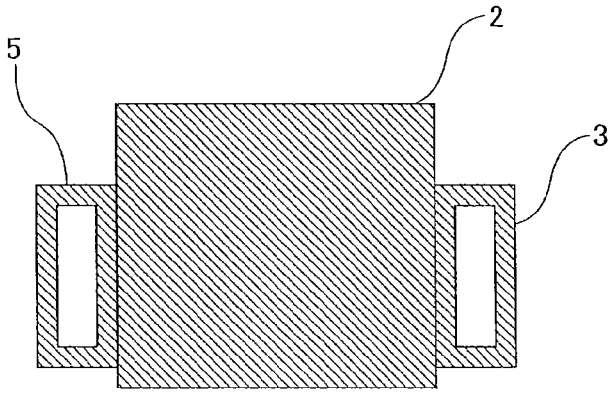
FIGS. 2A-2C are cross sectional views of the image forming apparatus taken along the line A-A in FIG. 1A, which illustrate relationships between a temperature-controlled portion and ducts.
Figure 2B:
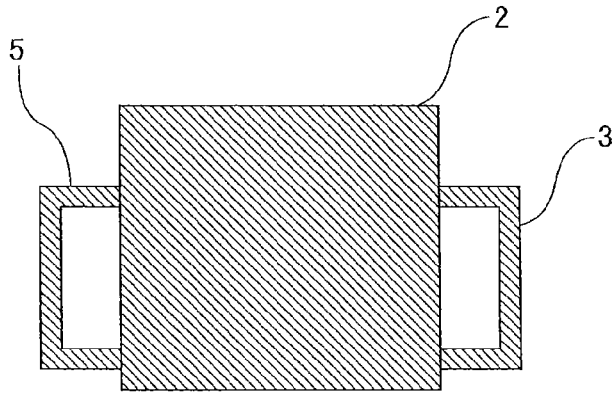
Figure 2C:
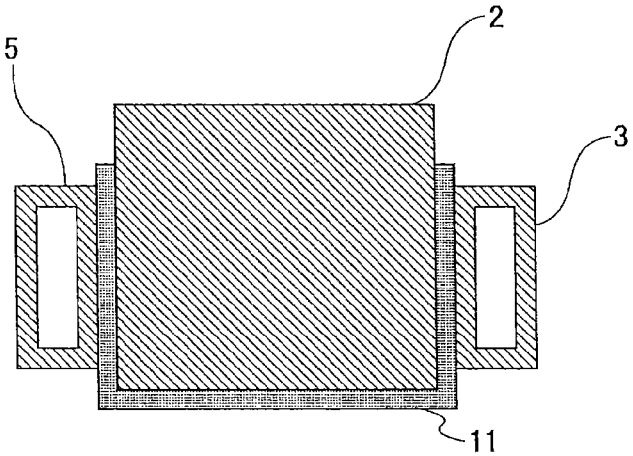

FIGS. 2A-2C are cross sectional views of the image forming apparatus taken along the line A-A in FIG. 1A, which illustrate relationships between the temperature-controlled portion 2 and the ducts 3 and 5. In FIG. 2A, the side surfaces of the temperature-controlled portion 2 are attached to the surfaces of the duct 5 from the air-conditioning device 4 and the open-air duct 3, respectively. The duct 5 and the open-air duct 3 are made of, for example, aluminum. By using the duct 5 and the open-air duct 3 made of aluminum, it is possible to obtain high heat-exchange efficiency between the circulating flow D1 in the duct 5 or the flow D2 in the open-air duct 3 and the temperature-controlled portion 2. Also, configured in this way, the circulating flow D1 from the air-conditioning device 4 does not leak out of the duct 3, and the open air flow D2 taken in from the outside of the image forming apparatus 1 does not leak out of the open-air duct 3. The flows D1 and D2 also do not mix with the air in the image forming apparatus 1.

FIG. 2B is a modified example of FIG. 2A in which the housing of the temperature-controlled portion 2 forms a part of the duct 5 and the open-air duct 3. Configured in this way, the circulating flow D1 from the air-conditioning device 4 and the flow D2 of the open-air taken in from the outside of the image forming apparatus 1 can exchange heat directly with the temperature-controlled portion 2. Also for this case, as the housing of the temperature-controlled portion 2 forms parts of the duct 5 and the open-air duct 3, the circulating flow D1 from the air-conditioning device 4 does not leak out of the duct 3, and the open air flow D2 taken in from the outside of the image forming apparatus does not leak out of the open-air duct 3. The flows D1 and D2 also do not mix with the air in the image forming apparatus 1.

FIG. 2C is a modified example of FIG. 2A in which a good heat conducting member 11 is interposed between the duct 5 and the temperature-controlled portion 2, and between the open-air duct 3 and the temperature-controlled portion 2. Both side surfaces of the temperature-controlled portion 2 are closely attached via the good heat conducting member 11 to the surface of the duct 3, in which the circulating flow D1 flows from the air-conditioning device 4 flows, and to the surface of the duct 5, in which the open air flow D2 flows from the outside of the image forming apparatus 1, respectively. The good heat conducting member 11 may be a member that has a high thermal conductivity in the direction parallel to the surface or the air flow (not in the depth direction), which may be made of a metal plate, a graphite sheet, a thin heat pipe or the like, and formed to fit to the shape of the temperature-controlled portion 2. By using the good heat conducting member 11, the temperature-controlled portion 2 can be heated or cooled uniformly because temperature distribution of the good heat conducting member 11 is narrow.

Here, in the examples shown in FIGS. 2A-2C, although both side surfaces of the temperature-controlled portion 2 are closely attached to the duct 5 and the open-air duct 3, both side surfaces do not necessarily need to be closely attached. Desirable locations to be attached to the duct 5 and the open-air duct 3 are locations that have high heat exchange efficiencies with the inside of the temperature-controlled portion 2. As such a location depends on a configuration within the temperature-controlled portion 2, it is desirable to position the duct 5 or the open-air duct 3 accordingly.

On the other hand, in the image forming apparatus 1, if temperature control is carried out with the air-conditioning device 4, it is difficult to achieve fine temperature control only with the air-conditioning device 4. Also, if the image forming apparatus 1 has multiple temperature-controlled portions 2 that need to be controlled to take different target temperatures, and there is only one air-conditioning device 4, a cooled or heated air at substantially the same temperature is sent to all the temperature-controlled portions 2. Therefore, it is difficult to achieve the target temperatures at the temperature-controlled portions 2, respectively (see the second embodiment later).

Alternatively, it may be possible to individually control the amount of flow of the air sent for heat exchange to each of the temperature-controlled portions 2 so that the temperature of each of the temperature-controlled portions 2 can be controlled. In this case, the temperature and amount of flow of the air sent from the air-conditioning device 4 are not independent, hence it requires appropriate control of a compressor of the air-conditioning device 4, output of a fan (the rotational speed) of a heat exchanger, the amount of flow sent to each of the temperature-controlled portions 2, and the like. However, in a situation where the amount of heat at portions in the image forming apparatus 1 is changing considerably, for example, soon after a starting-up or a change of operation mode, it is difficult to control the temperature of the temperature-controlled portions 2 appropriately.

Figure 3A:
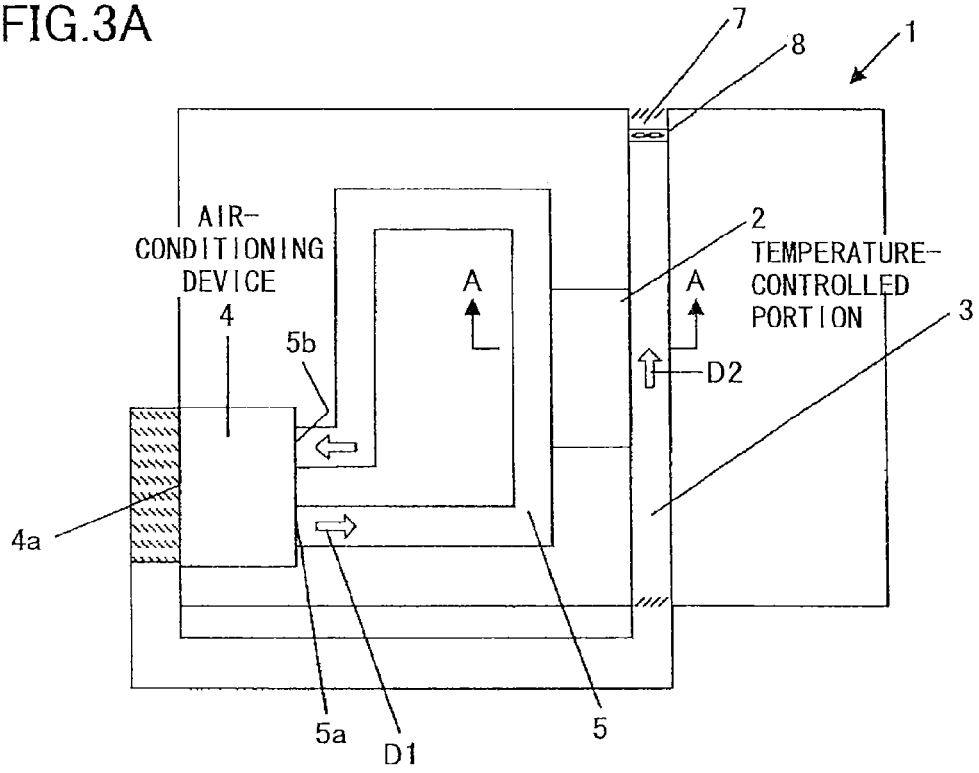
FIGS. 3A-3B are general configuration diagrams of an image forming apparatus according to a modified example of the first embodiment.
Figure 3B:
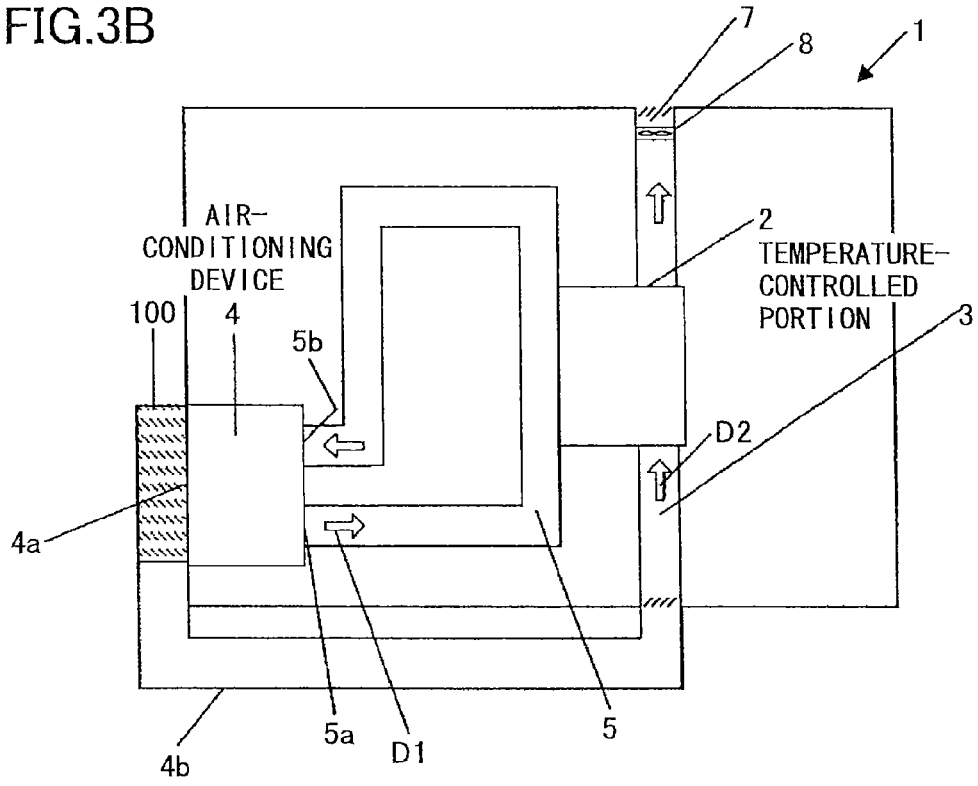

FIGS. 3A-3B are general configuration diagrams of the image forming apparatus 1 according to a modified example of the first embodiment, which copes with the above situations.

FIGS. 3A-3B are modified examples of FIGS. 1A-1B, respectively. In these modified examples shown in FIGS. 3A-3B, the air-conditioning device 4 further includes an air outlet 4*a* and an exhaust guiding duct 4*b* that is attached to the air outlet 4*a* for guiding exhaust from the air-conditioning device 4 after heat exchange to the open-air duct 3. Thus, the exhaust from the air-conditioning device 4 can be directly guided to the open-air duct 3 as a flow D2. By guiding the exhaust from the air-conditioning device 4 to the open-air duct 3 as the flow D2 via the exhaust guiding duct 4*b*, heat exhausted from the air-conditioning device 4 can be reused. Here, if the exhaust guiding duct 4*b* were not provided, the exhaust of the air-conditioning device 4 would be sent off out of the image forming apparatus 1 by the fan 103*a* of the second heat exchanger 103 of the air-conditioning device 4. In other words, the exhausted air is treated here as the open air, not as the circulating flow D1. On the other hand, the exhaust from the air outlet 7 of the open-air duct 3 is sent off to the outside of the image forming apparatus.

The following advantages are obtained when reusing the exhaust of the air-conditioning device 4 as the open air with the exhaust guiding duct 4*b*. Namely, as the air-conditioning device 4 is not highly responsive, and precision of temperature control is not high, if outside or inside temperature of the image forming apparatus changes suddenly, it is difficult to change the temperature of a flow to be sent off to the temperature-controlled portion 2 within a short time. However, if the exhaust from the air-conditioning device 4 (the second heat exchanger 103) is used, temperature difference between the first heat exchanger 102 and the second heat exchanger 103 can be determined by characteristics in FIG. 12C, which makes temperature control easier than in the case that uses the open air directly.

Namely, the exhaust of the air-conditioning device 4 may have a higher temperature than the open air. Therefore, by guiding the exhaust of the air-conditioning device 4 to the open-air duct 3 via the exhaust guiding duct 4*b* as shown in FIGS. 3A-3B, the air whose temperature is higher than the open air can be sent off to the temperature-controlled portion 2, with which the temperature of the temperature-controlled portion 2 can be raised rapidly.

As above, if the temperature of the air guided to the open-air duct 3 is high, the amount of flow of the air to be heat-exchanged at the temperature-controlled portion 2 becomes less. Consequently, power to drive the fan 8 can be reduced to be energy-efficient.

Also, since the exhaust temperature of the air-conditioning device 4 can be determined by the characteristics to a certain extent as described before, it is possible to predict the temperature of the air flowing through the open-air duct 3 to a certain extent. Therefore, for example, a movable louver may be provided on the exhaust guiding duct 4*b* from which the open air can be taken in with a variable mixing ratio to adjust the temperature of the air to be guided to the open-air duct 3.

[Second Embodiment]

Figure 4:
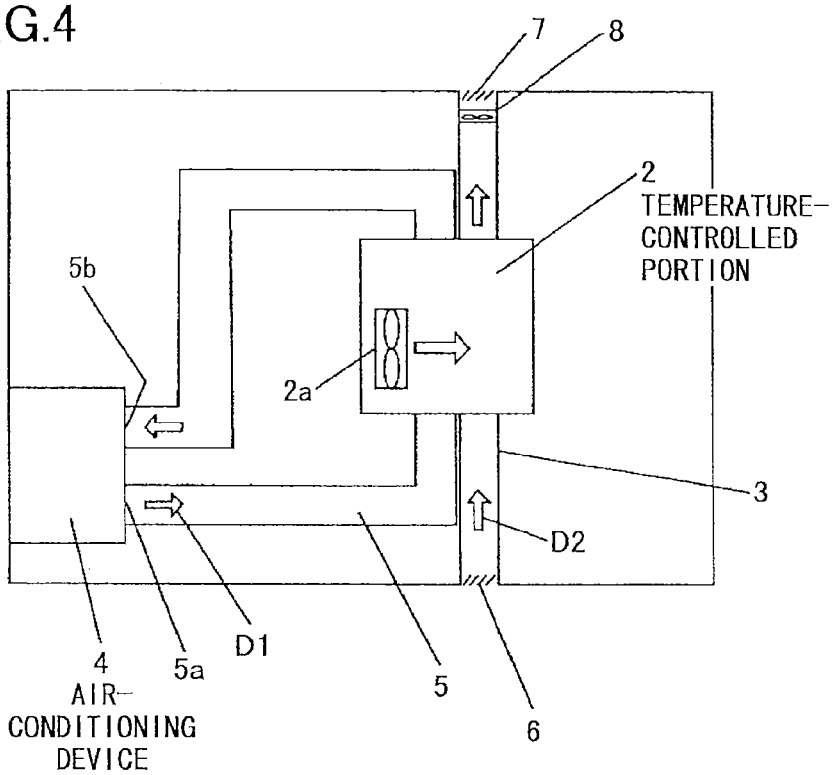
FIG. 4 is a general configuration diagram of an image forming apparatus according to a second embodiment.

FIG. 4 is a general configuration diagram of an image forming apparatus 1 according to the second embodiment. The second embodiment is a modified embodiment of the one illustrated with FIG. 1B in the first embodiment.

In the image forming apparatus 1 shown in FIG. 4, a fan 2*a* is added in the temperature-controlled portion 2 of the image forming apparatus 1 shown in FIG. 1B to generate an air flow in the temperature-controlled portion 2 for stirring the air in the temperature-controlled portion 2. Thus, it is possible to make the air flows joining in the temperature-controlled portion 2 uniform within a shorter time than that in the first embodiment shown in FIG. 1B, which makes it easier to control the temperature in the temperature-controlled portion 2 in a short time.

Here, it is also possible in the second embodiment to dispose the exhaust guiding duct 4*b* that guides the exhaust of the air-conditioning device 4 to the open-air duct 3 as in the modified examples of the first embodiment shown in FIGS. 3A-3B.

Other sections are configured and operated in the same way as in the first embodiment, hence overlapped description is omitted here.

[Third Embodiment]

Figure 5:
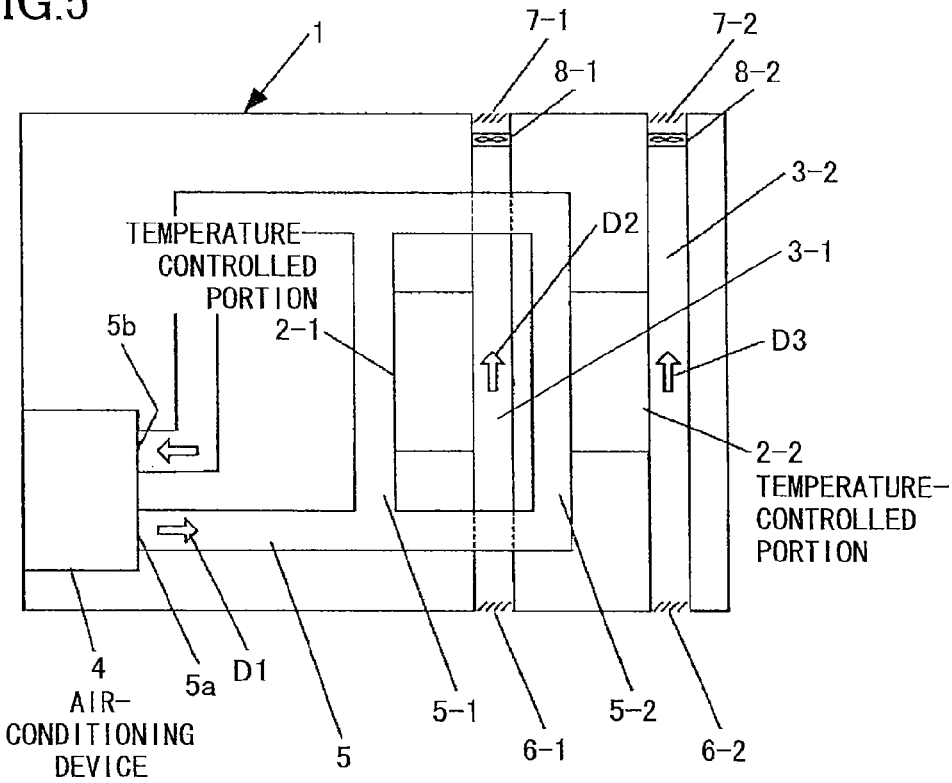
FIG. 5 is a general configuration diagram of an image forming apparatus according to a third embodiment.

FIG. 5 is a general configuration diagram of the image forming apparatus 1 according to the third embodiment. In the present embodiment, the image forming apparatus 1 includes first and second temperature-controlled portions 2-1 and 2-2 where temperature control is required. The first and second temperature-controlled portions 2-1 and 2-2 are attached to first and second ducts 5-1 and 5-2, respectively, which are branched off from the duct 5 coming from the air-conditioning device 4. The branched first and second ducts 5-1 and 5-2 make contact with the first and second temperature-controlled portions 2-1 and 2-2, respectively, then join to form the duct 5 again at a downstream location, which goes back to the air-conditioning device 4. Through the duct 5 and its branches, a circulating flow D1 (heated or cooled wind) sent off by the air-conditioning device 4 exchanges heat at the first and second temperature-controlled portions 2-1 and 2-2, then goes back to the air-conditioning device 4. Thus, heat exchange is carried out at the multiple temperature-controlled portions 2-1 and 2-2.

On the other side, the first and second temperature-controlled portions 2-1 and 2-2 are attached to first and second open-air ducts 3-1 and 3-2 that take in the air outside of the image forming apparatus 1 for heat exchange. The first and second open-air ducts 3-1 and 3-2 include first and second air inlets 6-1 and 6-2, first and second air outlets 7-1 and 7-2, and first and second fans 8-1 and 8-2, respectively.

The first and second open-air ducts 3-1 and 3-2 take in the air outside of the image forming apparatus 1 from the first and second air inlets 6-1 and 6-2 for exchanging heat at the first and second temperature-controlled portions 2-1 and 2-2, which is exhausted out of the image forming apparatus 1 from the first and second air outlets 7-1 and 7-2, respectively. In the present embodiment, the temperature and amount of flow of the circulating flow D1, which is sent off by the air-conditioning device 4 to pass through the first and second ducts 5-1 and 5-2, are the same for the first and second ducts 5-1 and 5-2. Also, flows D2 and D3, which pass through the first and second open-air ducts 3-1 and 3-2, respectively, are the open air taken in from outside of the image forming apparatus 1 that has substantially the same temperature as atmospheric temperature outside of the image forming apparatus 1. However, the amounts of flows D2 and D3, which pass through the first and second temperature-controlled portions 2-1 and 2-2, can be changed by changing outputs (the rotational speeds) of the first and second fans 8-1 and 8-2.

Configured in this way, the circulating flow D1 from the air-conditioning device 4 has the same heating or cooling effect at the first and second temperature-controlled portions 2-1 and 2-2. On the other hand, the amounts of flows D2 and D3 passing through the first and second open-air ducts 3-1 and 3-2, respectively, can be changed independently by controlling the first and second fans 8-1 and 8-2 independently. Therefore, it is possible to control the first and second temperature-controlled portions 2-1 and 2-2 to take respective predetermined temperatures easily.

In the present embodiment, although the example has two temperature-controlled portions 2, similar temperature control can be executed for more than two temperature-controlled portions 2. Namely, the circulating flow D1 from the air-conditioning device 4 can be supplied to temperature-controlled portions 2-1 to 2-*n* (where n is an integer greater than 2), respectively, and the open air can be supplied to the temperature-controlled portions 2-1 to 2-*n* by open-air ducts 3-1 to 3-*n*, respectively, whose amounts of flows are individually controlled for heat exchange to control temperatures at the temperature-controlled portions 2-1 to 2-*n*.

Also, the amount of flow of the circulating flow D1 from the air-conditioning device 4 may not be divided evenly for the temperature-controlled portions 2-1 and 2-2, but may be differentiated with, for example, shapes or cross sections of the first and second ducts 5-1 and 5-2. In this case, even if the amounts of flows are different, the amounts of flows just need to be stable with respect to ventilation output from the air-conditioning device 4. Namely, if the amounts of flows are stable, it is possible to precisely control temperatures at the first and second temperature-controlled portions 2-1 and 2-2 by combining temperature control by the air-conditioning device 4 and flow control by the first and second fans 8-1 and 8-2.

Here, it is also possible in the present embodiment to dispose the exhaust guiding duct 4*b* that guides the exhaust of the air-conditioning device 4 to the open-air duct 3 as in the modified examples of the first embodiment shown in FIGS. 3A-3B.

Other sections are configured and operated in the same way as in the first and second embodiments, hence overlapped description is omitted here.

[Fourth Embodiment]

Figure 6:
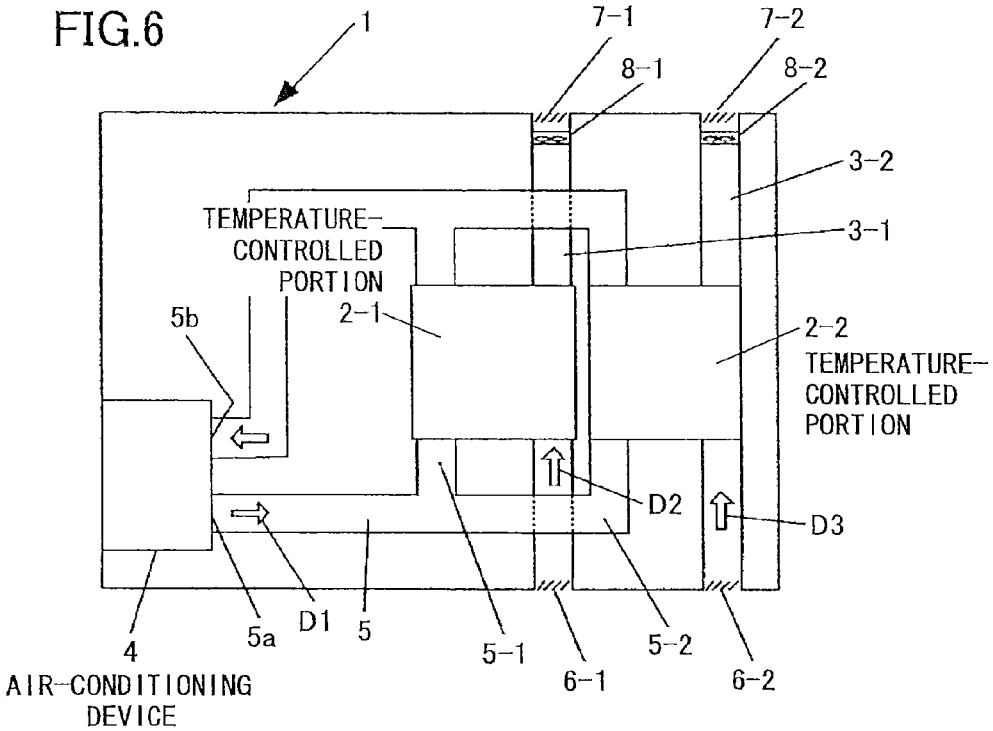
FIG. 6 is a general configuration diagram of an image forming apparatus according to a fourth embodiment.

FIG. 6 is a general configuration diagram of an image forming apparatus 1 according to the fourth embodiment. The present embodiment is a modified embodiment of the third embodiment, in which the image forming apparatus 1 has the first and second temperature-controlled portions 2-1 and 2-2 passed through by the first and second ducts 5-1 and 5-2, and the first and second open-air ducts 3-1 and 3-2, respectively, instead of bypassed.

In the present embodiment, the circulating flow D1 from the air-conditioning device 4 is divided into the first and second ducts 5-1 and 5-2. The divided flows go through the first and second temperature-controlled portions 2-1 and 2-2, respectively, which are joined again to go back to the air-conditioning device 4. At the same time, the first and second open-air ducts 3-1 and 3-2 feed flows D2 and D3, which are the open air taken in from the outside of the image forming apparatus, to the first and second temperature-controlled portions 2-1 and 2-2, respectively. In this case, the temperatures and amounts of flows of the open air that pass through the first and second open-air ducts 3-1 and 3-2 are the same.

Under this condition, when the flows D2 and D3 come into the first and second temperature-controlled portions 2-1 and 2-2 from the first and second open-air ducts 3-1 and 3-2, respectively, the flows D2 and D3 mix with the circulating flow D1 from the air-conditioning device 4 in the first and second temperature-controlled portions 2-1 and 2-2, respectively. The mixed air after heat exchange is exhausted out of the first and second temperature-controlled portions 2-1 and 2-2 to be distributed to the air-conditioning device 4 and the outside of the image forming apparatus. By exchange heat with the air being mixed in a short time, temperature distribution of the temperature-controlled portions 2-1 and 2-2 becomes narrow. Consequently, it is possible to control temperatures in the first and second temperature-controlled portions 2-1 and 2-2 easily.

Here, it is also possible in the fourth embodiment to dispose the exhaust guiding duct 4*b* that guides the exhaust of the air-conditioning device 4 to the open-air duct 3 as in the modified examples of the first embodiment shown in FIGS. 3A-3B.

Other sections are configured and operated in the same way as in the third embodiment, hence overlapped description is omitted here.

[Fifth Embodiment]

Figure 7:
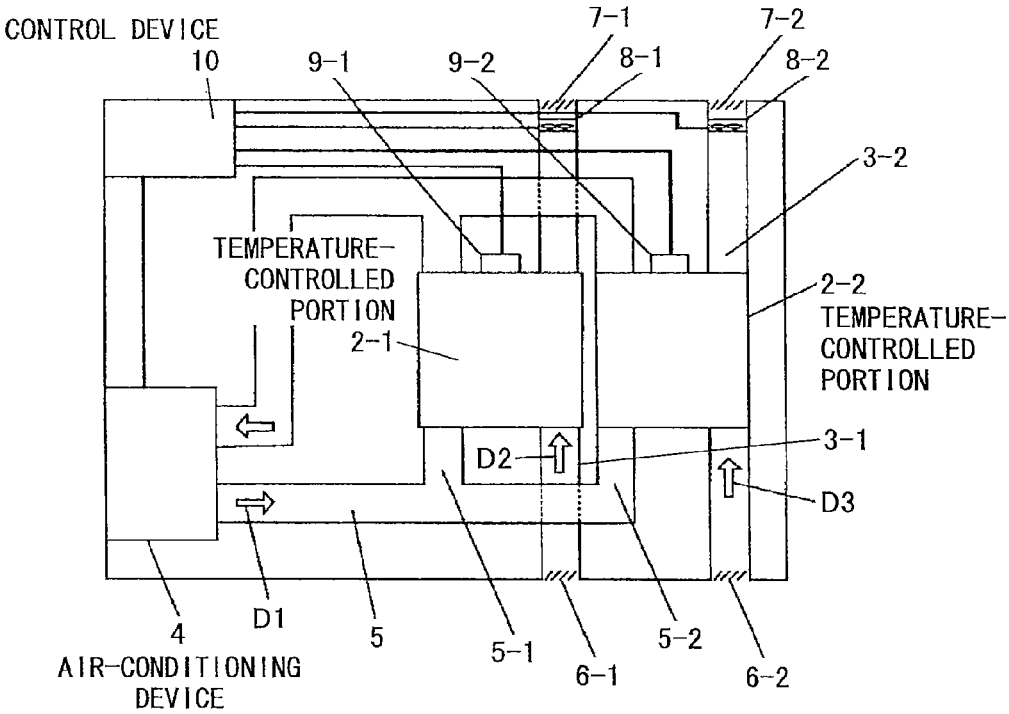
FIG. 7 is a general configuration diagram of an image forming apparatus according to a fifth embodiment.

FIG. 7 is a general configuration diagram of an image forming apparatus 1 according to the fifth embodiment. The present embodiment is a modified embodiment of the fourth embodiment, in which the image forming apparatus 1 has first and second temperature sensors 9-1 and 9-2 disposed at the first and second temperature-controlled portions 2-1 and 2-2, respectively, and a control device 10 for controlling the air-conditioning device 4 and the first and second fans 8-1 and 8-2 based on temperatures detected by the temperature sensors 9-1 and 9-2. Other sections are the same as in the fourth embodiment, hence overlapped description is omitted here.

The present embodiment differs from the fourth embodiment in that the first temperature-controlled portion 2-1 is attached to the first temperature sensor 9-1, and the second temperature-controlled portion 2-2 is attached to the second temperature sensor 9-2. The detected temperatures by the first and second temperature sensors 9-1 and 9-2 are input to the control device 10. The control device 10 controls the air-conditioning device 4 and the first and second fans 8-1 and 8-2 based on the detected temperatures input from the first and second temperature sensors 9-1 and 9-2. The first and second temperature sensors 9-1 and 9-2 detect internal temperatures of the first and second temperature-controlled portions 2-1 and 2-2, or external temperatures of housings of the first and second temperature-controlled portions 2-1 and 2-2, respectively. Specific locations where temperatures are detected depend on functions of the first and second temperature-controlled portions 2-1 and 2-2, hence they are not explicitly specified here.

Based on the detected temperatures, the air-conditioning device 4 controls the temperature of the circulating flow D1 to be supplied to the first and second temperature-controlled portions 2-1 and 2-2 through the first and second ducts 5-1 and 5-2. In addition to the temperature, the speed of the flow D1 may be controlled as well. The air-conditioning device 4 also controls outputs (the rotational speeds) of the first and second fans 8-1 and 8-2 based on the detected temperatures, for controlling the amounts of flows of the D2 and D3 supplied to the first and second temperature-controlled portions 2-1 and 2-2 taken in from the outside of the image forming apparatus 1.

When controlling with the control device 10 configured as above, the control device 10 controls the air-conditioning device 4 to set the temperature of the circulating flow D1 so that the first and second temperature-controlled portions 2-1 and 2-2 come to take temperatures close to target temperatures, and controls outputs (the rotational speeds) of the first and second fans 8-1 and 8-2 to get even closer to the individual target temperatures. Thus, it is possible to precisely control the multiple temperature-controlled portions 2-1 and 2-2 (or up to 2-*n*) to have individual different target temperatures.

Here, the control device 10 includes a CPU, a ROM and a RAM (not shown), where the CPU includes a control section for controlling interpretation of instructions and flow of a program, and an arithmetic section to execute arithmetic operations. A program, which includes instructions to be executed, is stored in the ROM. When being executed, the instructions are fetched from the ROM and stored in the RAM.

FIG. 8 is a schematic view of control patterns illustrating a control method executed by the control device 10 according to the fifth embodiment.

In FIG. 8, T1 represents the temperature of the first temperature-controlled portion 2-1, T1*t* represents the target temperature of the first temperature-controlled portion 2-1, T2 represents the temperature of the second temperature-controlled portion 2-2, and T2*t* represents the target temperature of the second temperature-controlled portion 2-2. The temperatures T1 and T2 are detected by the first and second temperature sensors 9-1 and 9-2, respectively.

In the present embodiment, the following control is executed.

$$\text{If } T1t \leq T2t, \quad 1.$$

(1) If $T1 \leq T1t$ and $T2 \leq T2t$, the control device 10 controls the air-conditioning device 4 to execute a heating operation to make T2 be T2*t*, controls the second fan 8-2 to stop, and controls the rotational speed of the first fan 8-1 to make T1 be T1*t*.

(2) If $T1 > T1t$ and $T2 \leq T2t$, the control device 10 controls the air-conditioning device 4 to execute a cooling operation to make T1 be T1*t*, controls the first fan 8-1 to stop, and controls the rotational speed of the second fan 8-2 to make T2 be T2*t*.

(3) If $T1 \leq T1t$ and $T2 > T2t$, the control device 10 controls the air-conditioning device 4 to execute a cooling operation to make T2 be T2*t*, controls the second fan 8-2 to stop, and controls the rotational speed of the first fan 8-1 to make T1 be T1*t*.

(4) If $T1 > T1t$ and $T2 > T2t$, the control device 10 controls the air-conditioning device 4 to execute a cooling operation to make T1 be T1*t*, controls the first fan 8-1 to stop, and controls the rotational speed of the second fan 8-2 to make T2 be T2*t*.

$$\text{If } T2t < T1t, \quad 2.$$

(1) If $T1 \leq T1t$ and $T2 \leq T2t$, the control device 10 controls the air-conditioning device 4 to execute a heating operation to make T1 be T1*t*, controls the first fan 8-1 to stop, and controls the rotational speed of the second fan 8-2 to make T2 be T2*t*.

(2) If $T1 > T1t$ and $T2 \leq T2t$, the control device 10 controls the air-conditioning device 4 to execute a cooling operation to make T1 be T1*t*, controls the first fan 8-1 to stop, and controls the rotational speed of the second fan 8-2 to make T2 be T2*t*.

(3) If $T1 \leq T1t$ and $T2 > T2t$, the control device 10 controls the air-conditioning device 4 to execute a cooling operation to make T2 be T2*t*, controls the second fan 8-2 to stop, and controls the rotational speed of the first fan 8-1 to make T1 be T1*t*.

(4) If T1>T1*t* and T2>T2*t*, the control device 10 controls the air-conditioning device 4 to execute a cooling operation to make T2 be T2*t*, controls the second fan 8-2 to stop, and controls the rotational speed of the first fan 8-1 to make T1 be T1*t*.

It can be implied with FIG. 8 and the description above that the control device 10 controls the relevant sections as follows:

1. If both of the temperatures of the first and second temperature-controlled portions 2-1 and 2-2 are higher than the target temperatures T1*t* and T2*t*, respectively, the air-conditioning device 4 executes a cooling operation targeting one of the temperature-controlled portions 2-1 and 2-2 that has a lower target temperature of T1*t* or T2*t* (1. (4), 2. (4)).

2. If both of the temperature of the first and second temperature-controlled portions 2-1 and 2-2 are lower than the target temperatures T1*t* and T2*t*, respectively, the air-conditioning device 4 executes a heating operation targeting one of the temperature-controlled portions 2-1 and 2-2 that has a higher target temperature of T1*t* or T2*t* (1. (1), 2. (1)).

3. In the above cases, the fan for supplying the open air to the targeting temperature-controlled portion is stopped, whereas the fan for supplying the open air to the other temperature-controlled portion is controlled to adjust the rotational speed to achieve the target temperature.

4. If either one of the temperatures of the first and second temperature-controlled portions 2-1 and 2-2 is higher than the target temperature, and the temperature of the other one is lower than the target temperature, the air-conditioning device 4 executes a cooling operation targeting the temperature-controlled portion that has the higher temperature than the target temperature (1. (3), 2. (2), 1. (2), 2. (3)).

5. In these cases, the fan for supplying the open air to the targeted temperature-controlled portion is stopped, whereas the fan supplying the open air to the other temperature-controlled portion is controlled to adjust the rotational speed to achieve the target temperature.

When the image forming apparatus 1 is in operation, the temperatures of the temperature-controlled portions 2 tend to rise because these portions generate heat by themselves or are heated by surrounding heat-generating members. Therefore, the air-conditioning device 4 executes a cooling operation targeting the temperature-controlled portion 2 whose temperature is higher than its target temperature. At the same time, the fan supplying the open air to the targeted temperature-controlled portion 2 is stopped, whereas the fan supplying the open air to the other temperature-controlled portion 2 is controlled to adjust the rotational speed to achieve the target temperature (to economize cooling performance). Thus, both temperatures of the temperature-controlled portions 2 can approach the target temperatures.

Here, it is also possible in the fifth embodiment to dispose the exhaust guiding duct 4*b* that guides the exhaust of the air-conditioning device 4 to the open-air duct 3 as in the modified examples of the first embodiment shown in FIGS. 3A-3B.

[Sixth Embodiment]

Figure 9:
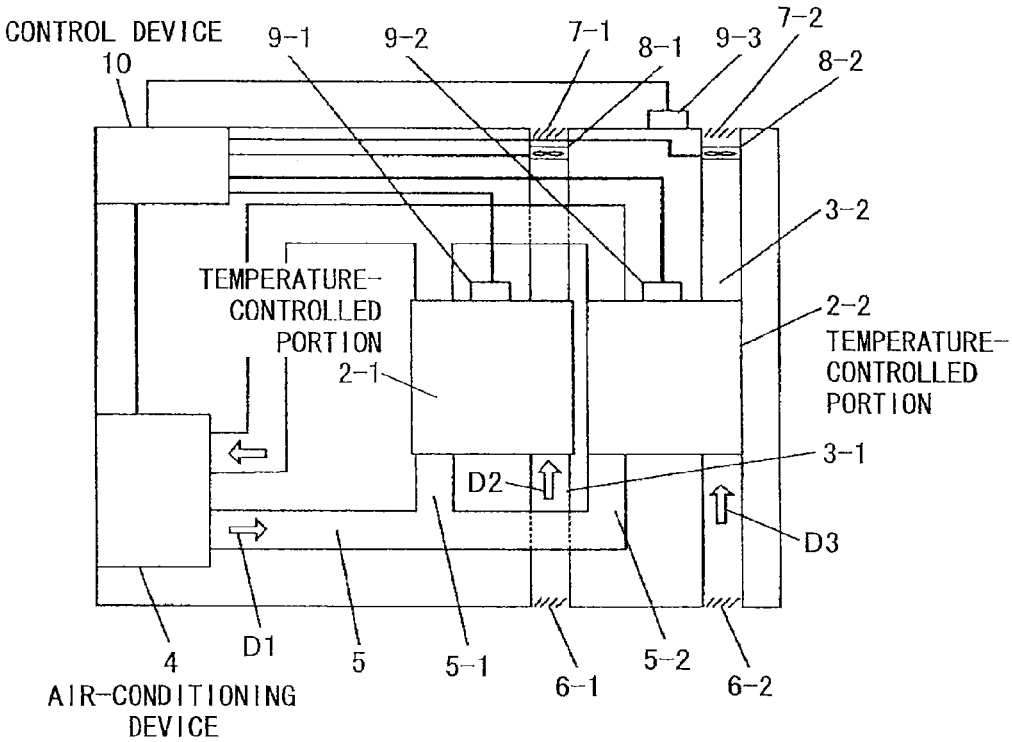
FIG. 9 is a general configuration diagram of an image forming apparatus according to a sixth embodiment.

FIG. 9 is a general configuration diagram of an image forming apparatus 1 according to the sixth embodiment. The present embodiment is a modified embodiment of the fifth embodiment in which the image forming apparatus 1 has an additional third temperature sensor 9-3 that detects temperature of the open air (atmospheric temperature outside of the image forming apparatus). The temperature detected by the third temperature sensor 9-3 is input to the control device 10. The control device 10 controls outputs of the first and second fans 8-1 and 8-2 based on detected temperatures obtained by the temperature sensors 9-1, 9-2, and 9-3. Other sections are configured in the same way as in the fifth embodiment.

Configured in this way, it is possible to finely control the amounts or speed of flows D2 and D3 taken in the first and second temperature-controlled portions 2-1 and 2-2 by referring to the temperature of the open air. Consequently, different target temperatures of multiple temperature-controlled portions 2 can be controlled easily and precisely.

For example, if the air-conditioning device 4 executes a cooling operation when the open air temperature is lower than the target temperature of the temperature-controlled portion 2, the control target temperature of the air-conditioning device 4 is set to higher than the target temperature of the temperature-controlled portion 2. For example, suppose atmospheric temperature of the open air is 25° C., and the target temperatures of the first and second temperature-controlled portions 2-1 and 2-2 are 40° C. and 45° C., respectively. Without a cooling operation, these temperatures may rise to 60° C. Therefore, the control target temperature of the air-conditioning device 4 is set to a higher value than the target temperatures, for example, 50° C., and the 25° C. open air is taken in from the first and second ducts 3-1 and 3-2. This saves energy because the control target temperature of the air-conditioning device 4 is set to 50° C., which is 10° C. higher than 40° C. A different target temperature can be treated by changing the amount of flow of the open air.

Here, it is also possible in the sixth embodiment to dispose the exhaust guiding duct 4*b* that guides the exhaust of the air-conditioning device 4 to the open-air duct 3 as in the modified examples of the first embodiment shown in FIGS. 3A-3B. In this case, control is executed by having the third temperature sensor 9-3 detect atmospheric temperature of flowing air in the exhaust guiding duct 4*b*. Similarly, if a movable louver is provided, energy can be saved by combining air flows having different temperatures, one is the open air taken in via the movable louver, and the other is air exhausted by the air-conditioning device 4.

Other sections are configured and operated in the same way as in the fifth embodiment, hence overlapped description is omitted here.

[Seventh Embodiment]

Figure 10:
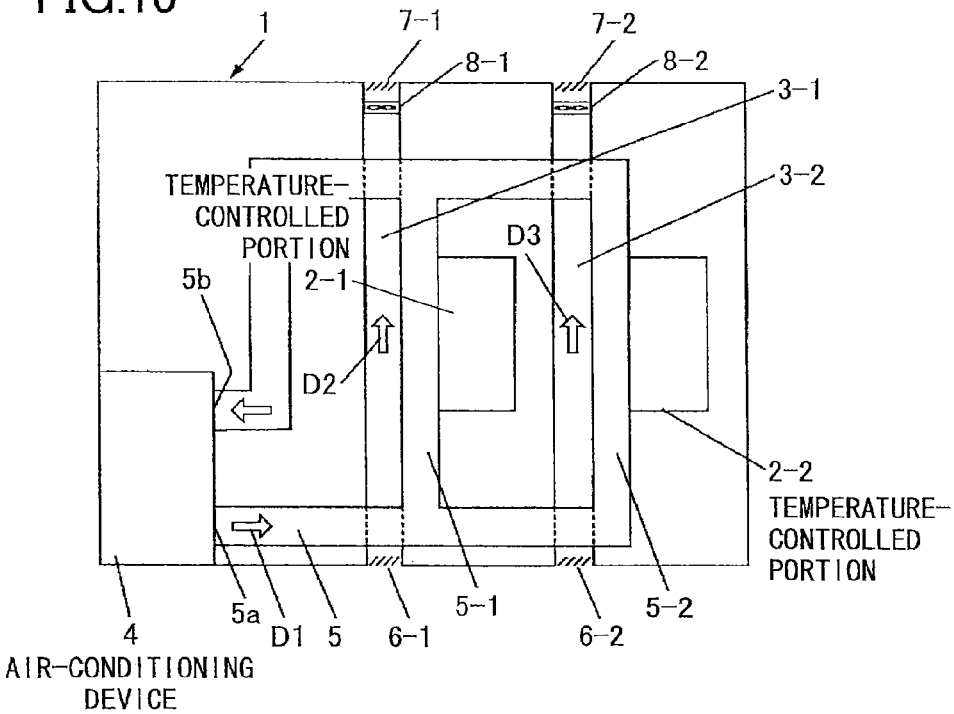
FIG. 10 is a general configuration diagram of an image forming apparatus according to a seventh embodiment.

FIG. 10 is a general configuration diagram of an image forming apparatus 1 according to the seventh embodiment. The present embodiment is a modified embodiment of the fourth embodiment, in which the image forming apparatus 1 has the first and second open-air ducts 3-1 and 3-2 attached to the first and second ducts 5-1 and 5-2, respectively, instead of attached to the first and second temperature-controlled portions 2-1 and 2-2. Other sections are the same as in the fourth embodiment, to which the same numeral codes are assigned, hence overlapped description is omitted here.

In the present embodiment, the first open-air duct 3-1 is closely attached to the first duct 5-1, and the second open-air duct 3-2 is closely attached to the second duct 5-2, from an upstream position to a downstream position in the air flowing direction relative to the first and second temperature-controlled portions 2-1 and 2-2, respectively. Configured in this way, heat is exchanged between the circulating flow D1 from the air-conditioning device 4 in the first duct 5-1 and the flow D2 in the first open-air duct 3-1, and between the circulating flow D1 of the air-conditioning device 4 in the second duct 5-2 and the flow D3 in the second open-air duct 3-2, which affects the first and second temperature-controlled portions 2-1 and 2-2.

In the present embodiment, the circulating flow D1 passes through the first and second ducts 5-1 and 5-2 at substantially the same temperature and with the same amount of flow. Also, the flows D2 and D3 that pass through the first and second open-air ducts 3-1 and 3-2 are the open air flows taken in from the outside of the image forming apparatus 1, which have substantially the same temperature. However, the amounts of the flows D2 and D3 can be set different by changing outputs of the first and second fans 8-1 and 8-2. Therefore, the circulating flow D1 of the air-conditioning device 4 has substantially the same heating or cooling effects at the first and second temperature-controlled portions 2-1 and 2-2, whereas the amounts of flows D2 and D3 can be controlled individually by controlling the first and second fans 8-1 and 8-2 independently. Consequently, it is possible to control the first and second temperature-controlled portions 2-1 and 2-2 to have predetermined temperatures easily.

Although two temperature-controlled portions 2-1 and 2-2 are included in the present embodiment, it is possible to control temperatures of more than two temperature-controlled portions 2 in a similar way, by applying the circulating flow D1 from the air-conditioning device 4, and individually controlling the amounts of flows D2, D3, and so on, which are taken in from the open air to exchange heat.

Moreover, as mentioned earlier, the amount of flow of the circulating flow D1 from the air-conditioning device 4 may not be divided evenly for the temperature-controlled portions 2-1 to **2-*n*, but may be differentiated with, for example, shapes or cross sections of the ducts 5-1 to 5-*n*. In this case, to control temperatures securely, the amounts of flows need to be stable with respect to ventilation output from the air-conditioning device 4**.

Also, in the present embodiment, although the first and second ducts 5-1 and 5-2 are attached to the first and second open-air ducts 3-1 and 3-2, from an upstream position to a downstream position relative to the first and second temperature-controlled portions 2-1 and 2-2, respectively, the attached ranges may be shorter. Instead of the range from the upstream position to the downstream position, it may be sufficient to have only a part of an upstream location attached. Also, heat exchange efficiency may be improved between the circulating flow D1 and the duct 5-1 or 5-2, between the flow D2 and the open-air duct 3-1, and between the flow D3 and the open-air duct 3-2, respectively, by expanding the attached area between the duct 5-1 and the open-air duct 3-1 or the duct 5-2 and the open-air duct 3-2 by forming dents on the external surfaces, or by adding fins to the internal surfaces of the duct 5-1 and the open-air duct 3-1.

Here, it is also possible in the seventh embodiment to dispose the exhaust guiding duct **4*b* that guides the exhaust of the air-conditioning device 4 to the open-air duct 3 as in the modified examples of the first embodiment shown in FIGS. 3A-3**B.

As described above, the preferred embodiments have the following effects.

1) An image forming apparatus 1 includes an air-conditioning device 4 to control at least one of temperature and humidity of the air, a duct 5 to guide a circulating flow D1 sent off by the air-conditioning device 4 to a temperature-controlled portion 2, and an open-air duct 3 to take in the air outside of the image forming apparatus by a fan 8 and to guide the air (a flow D2) to the temperature-controlled portion 2. Therefore, it is possible to apply the circulating flow D1 supplied by the air-conditioning device 4 and the flow D2 taken in from the outside of the image forming apparatus at the same time to the temperature-controlled portion 2, which enables efficient temperature control even if the amount of heat generated at the temperature-controlled portion 2 is changing considerably.

2) If there are multiple temperature-controlled portions 2, multiple ducts 5-1 to **5-*n* and multiple open-air ducts 3-1 to 3-*n* can be attached to multiple temperature-controlled portions 2-1 to 2-*n*, respectively, and heat exchange can be executed with the single air-conditioning device 4. Therefore, it is possible to control multiple control target temperatures at the multiple temperature-controlled portions 2 with the single air-conditioning device 4** easily.

3) The duct 5 and the open-air duct 3 may join at the temperature-controlled portion 2 to mix the flows D1 and D2 at the temperature-controlled portion 2, which makes temperature distribution of the temperature-controlled portion 2 narrower. Also, the mixed flow can be made uniform in a shorter time, which cools or heats the temperature-controlled portion 2 efficiently. By adding a fan **2*a* to stir air in the temperature-controlled portion 2, it is possible to cool or heat the temperature-controlled portion 2** more efficiently.

4) The image forming apparatus 1 may further include first and second temperature sensors 9-1 and 9-2 for detecting temperatures of the first and second temperature-controlled portions 2-1 and 2-2, and the control device 10 for controlling the temperature of the circulating flow D1 supplied by the air-conditioning device 4 and the amounts of flows D2 and D3 taken in by fans 8-1 and 8-2 based on the temperatures detected by the first and second temperature sensors 9-1 and 9-2. Consequently, different target temperatures of the temperature-controlled portions 2-1 and 2-2 can be finely controlled with the single air-conditioning device 4.

5) The control device 10 controls the air-conditioning device 4 to execute an operation targeting one of multiple temperature-controlled portions 2 that has the lowest or highest target temperature so that the targeted temperature-controlled portion 2 takes the target temperature and the other temperature-controlled portions 2 are supplied with appropriate amounts of flows D2, D3 and so on to achieve the target temperature at the targeted temperature-controlled portion 2. Therefore, it is possible to supply the temperature-controlled portions 2 other than the targeted temperature-controlled portion 2 that has the lowest or highest target temperature, with flows whose temperatures are below or above the temperature of the circulating flow D1 from the air-conditioning device 4. This makes it is possible to easily control the temperatures of the temperature-controlled portions 2 other than the targeted temperature-controlled portion 2 that has the lowest or highest target temperature, by controlling the rotational speeds (outputs) of fans 8-1, 8-2 and so on.

6) The image forming apparatus 1 may further include the third temperature sensor 9-3 for detecting atmospheric temperature outside of the image forming apparatus 1 to input the detected temperature to the control device 10. Based on the detected temperatures obtained by the first to third temperature sensors 9-1 to 9-3, the control device 10 controls the air-conditioning device 4 to execute temperature control, and the fans 8-1 and 8-2 to execute flow control. Therefore, different target temperatures of multiple temperature-controlled portions 2 can be controlled effectively.

7) When the air-conditioning device 4 executes a cooling operation, if the open air temperature detected by the third temperature sensor 9-3 is lower than the target temperature of the temperature-controlled portion, the target cooling temperature of the air-conditioning device 4 is set higher than the target temperature of the temperature-controlled portion to use the open air for effective cooling. Consequently, the cooling performance of the air-conditioning device 4 can be curbed, to make it energy-efficient.

8) An image forming apparatus 1 includes an air-conditioning device 4 to control at least one of temperature and humidity of the air, a duct 5 to guide a circulating flow D1 sent by the air-conditioning device 4 to a temperature-controlled portion 2, and an open-air duct 3 to take in the air outside of the image forming apparatus by a fan 8 and to guide the air (a flow D2) to the temperature-controlled portion 2. The open-air duct 3 may be attached to the duct 5, which enables heat exchange between the flow D2 in the open-air duct 3 and the temperature-controlled portion 2 via the duct 5. Thus, the temperature of the temperature-controlled portion 2 can be controlled even if the open-air duct is not directly attached to the temperature-controlled portion 2.

9) The duct 5 and the open-air duct 3 contact each other at an upstream location in the air flow direction relative to the temperature-controlled portion 2. Therefore, the circulating flow in the duct 5 and the flow D2 in the open-air duct 3 can exchange heat to control the temperatures of the air flows in the duct 5 and the open-air duct 3. Moreover, the duct 5 or the open-air duct 3 contacts the temperature-controlled portion 2 at a downstream location, with which heat exchange between the temperature-controlled flow and the temperature-controlled portion 2 can be done.

10) The exhaust guiding duct 4*b* may be provided that guides the exhaust out of the air-conditioning device 4 into the open-air duct 3, with which heat exchange at the temperature-controlled portion 2 becomes more effective to save energy.

It is noted here that correspondence between the terms in the claims and in the embodiments are as follows: the air in the claims corresponds to the circulating flow (air for heat exchange) D1, or the flow (the open air that is taken in) D2 or D3 in the embodiments; the air-conditioning section corresponds to the air-conditioning device 4; the image forming apparatus corresponds to the image forming apparatus 1; the temperature-controlled portion corresponds to the temperature-controlled portion 2, or the first and second temperature-controlled portions 2-1 and 2-2; the first passage corresponds to the duct 5, or the first and second ducts 5-1 and 5-2; the air-intake section corresponds to the fan 8, or the first and second fans 8-1 and 8-2; the second passage corresponds to the open-air duct 3, or the first and second ducts 3-1 and 3-2; the stirring section corresponds to the fan 2*a*; the first temperature detecting section corresponds to the first and second temperature sensors 9-1 and 9-2; the second temperature detecting section corresponds to the third temperature sensor 9-3; and the third passage corresponds to the exhaust guiding duct 4*b*.

The present invention has been described above with preferred embodiments. The present invention, however, is not limited to these embodiments, but various variations and modifications may be made without departing from the scope of the present invention.

The present application is based on and claims the benefit of priority of Japanese Priority Application No. 2012-127193 filed on Jun. 4, 2012, and Japanese Priority Application No. 2012-186492 filed on Aug. 27, 2012, the entire contents of which are hereby incorporated by reference.

What is claimed is:

1. An image forming apparatus comprising:

an enclosure;

a temperature-controlled portion provided in the enclosure and which generates heat;

an air-conditioning section including a portion that controls both temperature and humidity of air;

a first passage to guide air having the controlled temperature and humidity to the temperature-controlled portion, to remove at least a portion of the generated heat from the temperature-controlled portion;

an air-intake section to take in air from outside of the enclosure, and not having the controlled temperature and humidity; and a second passage to guide the air taken in by the air-intake section, and not having the controlled temperature and humidity, to the temperature-controlled portion, to remove at least another portion of the generated heat from the temperature-controlled portion.

2. The image forming apparatus as claimed in claim 1, wherein the first passage and the second passage join at the temperature-controlled portion.

3. The image forming apparatus as claimed in claim 1, further comprising a stirring section to stir the air in the temperature-controlled portion.

4. The image forming apparatus as claimed in claim 1, wherein the second passage contacts the first passage.

5. An image forming apparatus comprising:

an air-conditioning section to control at least one of temperature and humidity of air;

a plurality of first passages to guide the air sent off by the air-conditioning section to a plurality of temperature-controlled portions in the image forming apparatus;

a plurality of air-intake sections to take in the air from outside of the image forming apparatus; and a plurality of second passages to guide the air taken in by the air-intake section to the plurality of temperature-controlled portions.

6. The image forming apparatus as claimed in claim 5, further comprising:

a plurality of first temperature detecting sections to detect respective temperatures of the plurality of temperature-controlled portions; and a control section to control temperature of the air sent off by the air-conditioning section, and respective amounts of flow of the air taken in by the plurality of air-intake sections, based on the detected respective temperatures, wherein the control section controls the air-conditioning section so that one temperature-controlled portion of the plurality of temperature-controlled portions having a target temperature of a lowest or highest temperature comes to take the target temperature, wherein the control section controls the respective amounts of flow of the air taken in by the plurality of air-intake sections so that the plurality of temperature-controlled portions other than the one temperature-controlled portion come to take respective target temperatures.

7. The image forming apparatus as claimed in claim 6, further comprising:

a second temperature detecting section to detect temperature of the air outside of the image forming apparatus for inputting the detected temperature to the control section, wherein the control section controls the air-conditioning section to execute temperature control, and the plurality of air-intake sections to execute flow control, based on the respective temperatures detected by the plurality of first temperature detecting sections and the temperature detected by the second temperature detecting section.

8. The image forming apparatus as claimed in claim 7, wherein when the air-conditioning section executes a cooling operation, if the temperature detected by the second temperature detecting section is lower than the target temperature of the temperature-controlled portion, temperature setting of the air-conditioning section is set higher than the target temperature of the temperature-controlled portion.

9. An image forming apparatus comprising:

an air-conditioning section to control at least one of temperature and humidity of air;

a first passage to guide the air sent off by the air-conditioning section to a temperature-controlled portion in the image forming apparatus;

an air-intake section to take in the air from outside of the image forming apparatus; and a second passage to guide the air taken in by the air-intake section to the temperature-controlled portion, further comprising:

a first temperature detecting section to detect temperature of the temperature-controlled portion; and a control section to control the temperature of the air sent off by the air-conditioning section and an amount of flow of the air taken in by the air-intake section.

10. An image forming apparatus comprising:

an air-conditioning section to control at least one of temperature and humidity of air;

a first passage to guide the air sent off by the air-conditioning section to a temperature-controlled portion in the image forming apparatus;

an air-intake section to take in the air from outside of the image forming apparatus; and a second passage to guide the air taken in by the air-intake section to the temperature-controlled portion, wherein the first passage and the second passage contact each other at an upstream location in an air flow direction relative to the temperature-controlled portion, and one of the first passage and the second passage contacts the temperature-controlled portion at a downstream location in the air flow direction relative to the upstream location.

11. An image forming apparatus comprising:

an air-conditioning section to control at least one of temperature and humidity of air;

a first passage to guide the air sent off by the air-conditioning section to a temperature-controlled portion in the image forming apparatus;

an air-intake section to take in the air from outside of the image forming apparatus; and a second passage to guide the air taken in by the air-intake section to the temperature-controlled portion, further comprising a third passage to guide exhaust out of the air-conditioning section into the second passage.

* * * * *